United States Patent [19]

Mattson et al.

[11] Patent Number: 5,077,066

[45] Date of Patent: Dec. 31, 1991

[54] METHOD FOR PREPARING FROZEN COMESTIBLES FOR CONSUMPTION

[75] Inventors: Peter H. Mattson, Hillsborough; Samson T. Hsia, Fremont, both of Calif.

[73] Assignee: The Clorox Company, Oakland, Calif.

[21] Appl. No.: 529,766

[22] Filed: May 25, 1990

Related U.S. Application Data

[63] Continuation of Ser. No. 119,522, Nov. 12, 1987, abandoned.

[51] Int. Cl.[5] ..... B65B 29/06; B65B 29/08; A23L 1/01

[52] U.S. Cl. ..... 426/234; 426/243; 426/393; 426/509; 426/107; 426/112

[58] Field of Search ..... 426/107, 234, 243, 113, 426/393, 112, 114, 115, 509

[56] References Cited

U.S. PATENT DOCUMENTS

| | | | |
|---|---|---|---|
| 610,902 | 9/1898 | Hetland . | |
| 1,076,780 | 10/1913 | Peter . | |
| 2,485,659 | 10/1949 | Robertson . | |
| 3,042,247 | 7/1962 | Bonnet | 220/44 |
| 3,213,634 | 10/1965 | Granata | 62/63 |
| 3,228,776 | 1/1966 | Savage et al. | 426/114 |
| 3,256,101 | 6/1966 | Arns . | |
| 3,402,568 | 9/1968 | Kamin et al. | 62/380 |
| 3,410,108 | 11/1968 | Wentworth et al. | 62/341 |
| 3,446,030 | 5/1969 | Rubin | 62/63 |
| 3,465,873 | 9/1969 | Munz | 426/114 |
| 3,468,369 | 9/1969 | Tetrick et al. | 165/2 |
| 3,479,188 | 11/1969 | Thelen . | |
| 3,567,468 | 3/1971 | Tressler . | |
| 3,615,646 | 10/1971 | Neely et al. . | |
| 3,700,847 | 10/1972 | Rendek et al. | 219/10.55 |
| 3,854,023 | 12/1974 | Levinson | 426/107 |
| 3,868,470 | 2/1975 | Fallon et al. | 426/302 |
| 3,982,404 | 9/1976 | Overbye | 62/57 |
| 3,985,991 | 10/1976 | Levinson | 426/243 |
| 3,987,267 | 10/1976 | Moore | 219/10.55 E |
| 4,252,268 | 2/1981 | Haire | 229/43 |
| 4,301,659 | 11/1981 | Martin et al. | 62/57 |
| 4,346,815 | 8/1982 | Raymor et al. | 220/306 |
| 4,390,554 | 6/1983 | Levinson | 426/107 |
| 4,390,555 | 6/1983 | Levinson | 426/234 |
| 4,425,368 | 1/1984 | Watkins | 426/107 |
| 4,439,656 | 3/1984 | Peleg | 219/10.55 E |
| 4,448,029 | 5/1984 | Keller | 62/63 |
| 4,478,868 | 10/1984 | Ariss et al. | 426/641 |
| 4,512,497 | 4/1985 | Grusin | 220/369 |
| 4,518,618 | 5/1985 | Hsia et al. | 426/262 |
| 4,574,174 | 3/1986 | McGonigle | 426/114 |
| 4,675,197 | 6/1987 | Banner et al. | 426/292 |

FOREIGN PATENT DOCUMENTS

| | | | |
|---|---|---|---|
| 479968 | 1/1952 | Canada | 426/114 |
| 969139 | 6/1975 | Canada | 426/114 |

OTHER PUBLICATIONS

"The Green Giant Puts a New Twist in His Vegetables," Free Standing Insert, The Pillsbury Company, Oct. 18, 1987.

Chem Abs. 91:37611E, "Effect of Reconstitution Conditions of a Precooked Frozen Food on Heating Time and Food Quality".

M. Karel, "Fundamentals of Dehydration Process," in: Advances in Preconcentration and Dehydration of Foods (Fd. A. Spicer) (1974).

Copson et al, "Browning Methods in Microwave Cooking," in: Agricultural and Food Chemistry, vol. 3, May, 1955, pp. 424–427.

*Primary Examiner*—Steven Weinstein

*Attorney, Agent, or Firm*—Millen, White & Zelano

[57] ABSTRACT

The invention comprises a method for preparing a frozen comestible for consumption, comprising:

(a) combining frozen food constituents with a substantially dry sauce concentrate;

(b) adding a discrete portion of a microwave-power absorbing liquid medium to the combination; and (c) heating the combination with a source of microwave power.

In a further embodiment, the invention also relates to a microwaveable, individual portion serving container, said container provided with a measuring closure, said container containing a frozen comestible comprising a quantity of frozen constituents and a substantially dry sauce concentrate, wherein said closure includes venting means to off-gas steam generated when said frozen comestible is combined with a microwave power absorbing liquid medium and heated with a source of microwave power.

6 Claims, 2 Drawing Sheets

METHOD FOR PREPARING FROZEN COMESTIBLES FOR CONSUMPTION

This is a continuation of Application Ser. No. 07/119,522, filed Nov. 12, 1987, now abandoned.

BACKGROUND OF THE INVENTION

1. Field of the Invention

This invention relates to methods of preparing frozen comestibles for immediate consumption.

2. Brief Statement on the Prior Art

Frozen convenience foods have made very successful inroads in the consumer marketplace. However, such frozen foods typically require long periods of time to heat viz., up to an hour and more, in conventional particularly those with large amounts of a frozen sauce primarily of water, fats, spices, thickeners and binders).

Certain prior art allow for more efficient heat exchange via an enclosure for the frozen convenience food, e.g., the so-called "boil-in-bag" for immersion in boiling water. The boil-in-bag technique obviates the need for a conventional oven, which heats primarily by radiation. It also is an efficient means of heat exchange, since the air in the interior of the bag is heated and the heated air evenly heats the frozen comestible therein. By using this heating source, relatively prompt heating occurs, and, unlike a conventional oven, the heated air is moist and will not tend to dehydrate the comestible as much as a conventional oven would, where such dehydration is undesirable. However, these boil-in-bag devices still suffer from drawbacks, such as the need to boil the water beforehand and a still considerable amount of cooking time. There is also a danger of dehydrating part of the comestible, or achieving inconsistent cooking times because of the differences in density of the materials cooked therein. One partial attempt to solve this latter problem was disclosed in Tressler, U.S. Pat. No. 3,567,468. Tressler disclosed individually quick frozen constituents which were combined with a dry sauce mix, all contained in a boil-in-bag. The dry sauce mix becomes hydrated upon heating the boil-in-bag by the residual moisture of the constituents of the comestible, e.g., the vegetables. Unfortunately, this technique still does not avoid the prior step of boiling water and requires monitoring so that the contents are not overcooked. Additionally, the amount of water or other liquid present in the comestible may not be sufficient to produce a desirable amount of sauce or coating, and more water may need to be initially added to the comestible, which basically adds another frozen mass which needs to be thawed during cooking, thereby increasing the heating time.

In a further step towards added consumer convenience, the microwave oven was introduced in the 1940's. Today, the number of microwave ovens in domestic use has been estimated at over 60% of all U.S. households and an even greater number in commercial use. Microwave ovens function by emitting radiation at a frequency (300 to 3,000 Megahertz, and, most preferably, 915 to 2,450 Megahertz) below that of visible light. When microwave radiation impinges a material, depending on whether the material transmits, absorbs, or reflects such radiation, the material may allow such radiation to pass through, may be heated or may redirect or intensify such radiation. Materials, such as glass, ice or certain plastics, allow microwave radiation to pass through with minimal or no absorption. Other materials, such as most metals, reflect microwave radiation. However, most foods containing moisture absorb, and thus, are heated by, microwave radiation. Briefly, microwave radiation acts as an applied electric field which causes the dipoles in water to orient themselves in a certain fashion along such electric field, thereby storing potential energy. Upon oscillation of the field, the dipoles attain a new equilibrium position, and the energy is released as kinetic energy (heat). Taking advantage of these unique properties of microwave radiation on foods, some companies have developed innovative products, such as The Clorox Company in Hsia et al, U.S. Pat. No. 4,518,618, which discloses microwaveable coating mixes, yielding crisp food coatings for a variety of food substrates; and The Pillsbury Company, with specialty microwaveable containers containing a metallized "susceptor" to crisp dough on products such as frozen pizza.

Thus, microwaveable frozen comestibles must be specialty-packaged. The material must be transparent to microwave radiation. However, because microwave heating involves heat generated internally in the frozen comestible, moisture losses due to evaporation can be just as severe as in conventional oven heating. Moreover, unevenly sized food constituents can lead to uneven heating, e.g., overheating as to some portions, underheating as to others, or a combination of these. This is because microwave radiation only penetrates to a certain depth of the food until energy is fully absorbed. The rest of the interior is heated by heat conduction only. Also, because most frozen food products contain premade sauce, and the sauce is constituted of some edible liquid, more problems can be observed. The sauce must be specially constituted to prevent separation into watery and solid phases. Most importantly, the relatively large amount of water or liquid in such sauces signifies longer exposure to microwave radiation is necessary to generate sufficient heat to melt the ice by conduction. This again leads to uneven heating.

One attempt to circumvent the problem of uneven heating is a recent introduction by General Foods Corporation under the brand name "Bird's-Eye Fresh Creations" frozen dinners. These products borrow on the boil-in-bag concept by separately pouching each of the main constituents in e.g., an entreé, for separate microwave heating of each. This approach, however, suffers from the complexity of the heating sequence (each separate constituent requires different heating times, different preparation, or both).

SUMMARY OF THE INVENTION

It has been surprisingly found that the foregoing disadvantages and drawbacks in the prior art are overcome by the present inventive method. The method of the invention attains even heating of each of the constituents of a frozen comestible, so as to prepare the comestible for immediate consumption. It also assures good mouth feel and tooth resistance with respect to items such as vegetables, which, upon overcooking, can suffer cellular breakdown and lose turgor. The invention further provides a microwaveable product with substantially reduced heating time in order to provide a ready-to-consume comestible in a minimum amount of time.

The invention comprises a method for preparing a frozen comestible for consumption, comprising:

(a) combining frozen food constituents with a substantially dry sauce concentrate;

(b) adding a discrete portion of a microwave-power absorbing liquid medium to the combination; and (c) heating the combination with a source of microwave power.

It is therefore an object of the invention to provide a method for preparing a frozen comestible for prompt consumption in a minimum amount of time.

It is a further object of the invention to provide an improved method for heating frozen comestibles by microwave radiation without requiring separate heating of each constituent.

It is a still further object of the invention to provide an improved method for heating a frozen comestible by microwave radiation in which a microwave-absorbing liquid medium which forms part of the comestible is used to evenly heat each of the constituents of the comestible.

It is another object of the invention to provide a method of heating a frozen comestible by microwave radiation in which individually quick frozen constituents and a substantially dry sauce mix form the solids portion of the comestible, and a separately added microwave-absorbing liquid medium forms the liquid portion of the comestible.

DETAILED DESCRIPTION OF THE PREFERRED EMBODIMENTS

Figure 1:
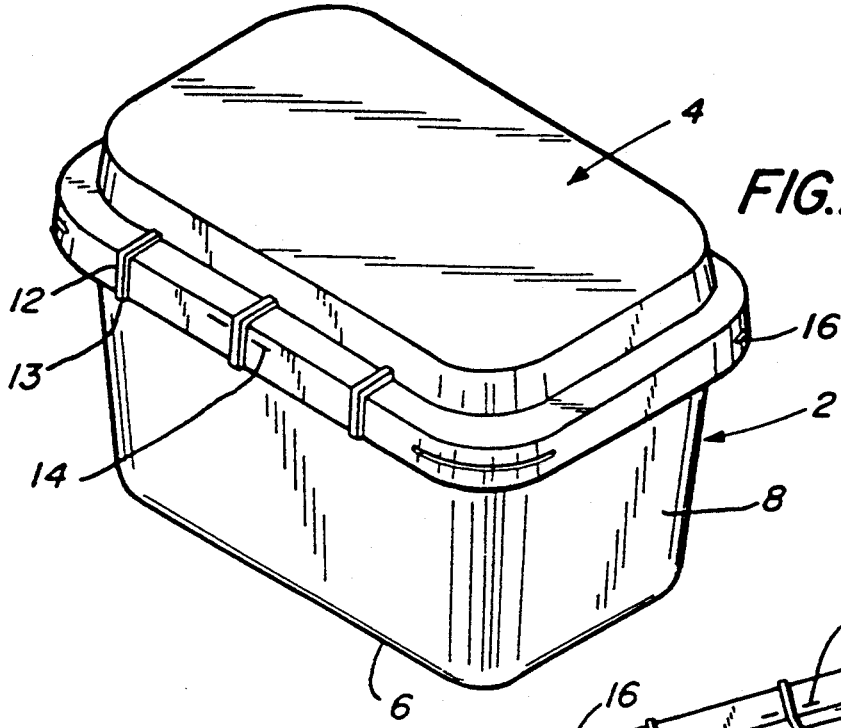
FIG. 1 shows a perspective view of the preferred container and measuring closure used to store and heat the comestibles of the invention.

The present invention provides microwaveable, frozen comestibles in the form of entreés which can be quickly heated by microwave radiation. These products heat evenly because unlike prior art products, the cooking medium, a microwave-absorbing liquid, e.g. water, is a separately added constituent which, because it is already in liquid phase, does not require the additional heating time as do present frozen food products, whose premade sauces contain large amounts of frozen liquids, thus forming large blocks of ice. These ice chunks prevent the even heating of such prior art products because of the different densities of such products and the uneven melting times of such products. Note that most frozen comestibles require rotation of the container in which they are heated (a drawback somewhat obviated by providing a self-actuated or mechanical turntable), in order to assure even heating. However, even with these steps, there is no assurance that foods with lower densities or which are more thinly sliced or separated are not overheated or dehydrated; or that more dense foods, or those surrounded by large ice masses (i.e., sauces) are underheated, resulting in a still cold or even frozen core.

In this invention, the following definitions apply:

"Individually quick frozen" means that the food constituents, e.g., vegetables, meats, poultry, fish, shellfish, pasta, grain products (e.g., rice, barley, oats, wheat) will be sized in certain discrete dimensions and subjected to freezing as quickly as possible via liquid nitrogen, dry ice, or forced cold air, in ways known to those skilled in the art. The most important aspect is the sizing and segregating of such constituents into discrete components.

"Microwave power absorbing liquid medium" means a liquid whose molecules form dipoles (i.e., shared pairs of opposite charges) when an electric field (microwave radiation) is applied thereto. Such medium is generally water, which is an excellent medium for microwave absorption; however, the water can be replaced with other liquids in which water is an integral constituent, e.g., milk, broth, brine, wine, or the like. However, oil-based sauces and dressings (e.g., mayonnaise) may also be utilized.

Although the term "microwave heating" has been used, this is merely a colloquial expression, since, actually, heating occurs when the food material is impinged by a source of microwave radiation, its molecules are reoriented, storing potential energy, and, upon oscillation of the power source, kinetic energy is released as heat, and such energy is conducted through the food material.

"Substantially dry sauce concentrate" means a mixture of food solids, spices, thickeners, fat or oil, seasonings, meats, and vegetables which have been combined and prepared so as to remove substantially most of the free water (i.e., that water which is not chemically bound to any of the constituents). Thus, in such substantially dry sauce concentrates, free water content should be less than preferably about 70%, more preferably less than 60%, and most preferably less than 55%, of the sauce concentrate.

THE PRODUCTS

The types of products preferably used in the inventive method are frozen food entrees. Such products provide an "all-in-one" meal, i.e., such as a casserole. As mentioned, the advantages of the invention over the prior art products are many, but one of the chief advantages is speed of the inventive method. Using a conventional household microwave oven rated at 700 watts, a full power application of microwave radiation on the product should yield a ready-to-consume product within less than five minutes total cooking time, most preferably, within less than three minutes total cooking time. An additional advantage is the evenness of heating since the microwaveable liquid medium, preferably water, is separately added, and is not frozen, which avoids the uneven heating of the prior art. These products will generally comprise a meat or mixture of meats, shellfish, poultry, or fish; a mixture of vegetables; a pasta or grain product; and the sauce concentrate. A wide variety of types of products which are attractive to the consumer market can be created and are marketed under such designations as "Italian Style," "Oriental Style," "Seafood Style," "Vegetarian Style," and the like.

The types of constituent ingredients which are usually individually quick frozen run a wide variety of items.

Meats, fish, shellfish, and other forms of edible protein comprise one group of typically added ingredients. In the case of shellfish, a commercially available substitute known as surimi (pollock or other whitefish, which is extruded and mixed with spices, binders and flavorings) can be utilized as an inexpensive substitute for various shellfish. For vegetarian style products, such well known meat substitutes as tofu (pressed bean curd), gluten-based materials, and soy products can be used. It should also be noted that some meat products, such as sausage, indeed, even other constituents may not necessarily be subjected to individual quick freezing processes. Some meat or products may merely be added to the assembled food product and then cooled down or otherwise frozen. Thus, while the majority of the constituents are individually quick frozen, such term is not to be construed as limiting the products or constituents of products of this invention.

Pasta and grain products form another important ingredient. Pasta can include not only semolina-based products, but also such items as Chinese and Japanese style noodles, such as mung bean threads. Grains include rice, wheat, oats, and other grains. Generally, these pasta and grain products are pre-cooked.

Vegetables comprise another important group of ingredients. Vegetables which contain smaller amounts of water (e.g., peas versus lettuce) withstand freezing and thawing relatively well, such as green beans, carrots and other types of vegetables, such as legumes. Others help to flavor the products as well, such as onions and garlic. Generally, these vegetables are least partially cooked, i.e., blanched, which helps to maintain color by deactivating enzymes and by removing some interstitial air.

These individually constituents will typically have a water content of anywhere from 15% to over 95% by weight. They will have densities of from about 0.25 to about 1.50 gm/cm$^3$. Size will vary from about 1–6 cms in length, 0.1 to 1 cm width and a similar thickness or depth. These size ranges appear optimal for uniform heat transference during microwave heating.

The dry sauce concentrate is a critical part of the products of this invention. Typically, the concentrate comprises a series of "dry" ingredients, such as powdered cheese, powdered milk, salt, emulsified oils, spices, seasonings, flavor additives, acidulants, sugars, food concentrates, food solids, emulsifiers, flow control agents, thickeners (e.g.s., flour, cornstarch and tapioca solids), soy, wine, and the like. These dry ingredients are paired with "wet" ingredients, such as cheese, butter, cream, meat, poultry, shellfish or fish bases, fresh vegetables, fats, oils, uncooked or cooked meats or poultry and the like.

Typically, the dry ingredients comprise about 20–80%, and the wet ingredients comprise 80–20% of the sauce concentrate, and the ratios of the two sets of ingredients are varied in accordance with the style of preparation. Generally, the wet and dry ingredients are constituted separately as portions of the sauce concentrate. The wet ingredients usually contain an oil or fat, in which a vegetable such as onions or carrots or other vegetables are sauteéd (to help flavor the oil or fat, and to reduce unnecessary moisture). Then the dry ingredients are added to form a highly viscous paste or dough. This paste or dough is frozen and combined with the individually quick frozen constituents previously described.

It has further been found that when oil or fat is present as one of the major "wet" ingredients in the sauce concentrate, the amount present is preferably about 5–50%, more preferably 10–40%, and most preferably 15–35% of the "wet" ingredients. Oil or fat is desirable to act as a liquid binder for the dry ingredients in the to-be-formed paste or dough and because certain vegetables and flavorings are initially sauteed in such oil or fat, the oil is thereby flavored. However, it has also been found that when a larger amount of oil or fat is present (e.g., above about 20% of the wet ingredients, resulting in about 4–11 grams of oil or fat in the finished, individual serving of an approximately 226 gram product) the paste or dough becomes highly fluid, and is difficult to handle or process in large batches or in a continuous process. Thus, in another preferred aspect of the invention, it is desirable to limit the fat or oil portion of the wet ingredients to less than about 20% of the wet ingredients, such that the finished product in a representative 226 gram serving contains about 1–4 grams of such fat or oil. Additional oil or fat can be added back to the product: by coating the pasta, grain or other constituents; by spraying the assembled products with a stream of oil or liquified fat just prior to sealing the storage package; or, by adding in the form of emulsified oils or fats added as separate particles (e.g., frozen fat or butter particles).

The proportion of sauce concentrate to the remaining constituents is typically about 5 to 50, more preferably 10 to 40, and most preferably about 12.5 to 30% sauce concentrate; pasta or grain product from 5 to 90, more preferably 10 to 80 and most preferably 15 to 60% meat, poultry, shellfish, fish, or meat substitute; 0 to 40, more preferably 5 to 35, and most preferably 10 to 35% ; and vegetables from 0 to 95, more preferably 5 to 90%, most preferably 10 to 50%.

In TABLE I below, typical ingredient dimensions, moisture content, and density are given:

TABLE I

Ingredient Dimensions

| Sizes are an approx. range) Length × Weight × Thickness (in cms.) | WATER CONTENT(%) | DENSITY gm/cm$^3$ |
|---|---|---|
| Cooked Fusilli (4.2 × 1.5) – (5.5 × 1.6) | 70 | 1.42 |
| Sliced Sausage (dia.) (2.5–3) × (.2–.3) thick | 48 | 1.06 |
| Green Bell Pepper (.7 × .9 × 6) – (1.8 × 1 × .6) | 94 | .76 |
| Tomato (2 × 3 × .5) – (1 × .6 × .7) | 93 | 1.05 |
| Gemellini, Cooked 1.8 × .7 | 70 | 1.42 |
| Broccoli 3.15 cube - 1.26 cube | 91 | .76 |
| Sliced Carrots (1.5 × .8) – (2.7 × .9) | 91 | 1.06 |
| Peas (dia.) .7–1 | 86 | .49 |
| Red Bell Pepper (3.7 × 1 × .5) – (1 × 1 × .5) | 91 | .92 |
| Canestrini, Cooked (6 × 1.9) | 70 | 1.42 |
| Diced Chicken (1 × 1.4 × .5) – (1.5 × 1.3 × .7) | 64 | 1.29 |
| Quartered Zucchini (2 × 2 × .7) – (3 × 3 × .7) | 95 | .71 |
| Sliced Mushroom (2 × 1 × .4) – (3.5 × 4 × .4) | 93 | .95 |
| Penne Riggate - Cooked 6–7 | 70 | 1.42 |
| Cooked Beef Ground .315–.63 | 60 | .367 |
| Cooked Pork Ground .315–.63 | 56 | .353 |
| Cooked Mafalda (2 × 5 × .2) | 70 | 1.42 |
| Crumbled Sausage .1 × 1.5, diced | 48 | 1.06 |
| Mozzarella Cheese .5 × .2 × .4 (bits) | 48 | .43 |
| Spinach Spirale, Cooked 5 × 1.2 | 70 | 1.42 |
| Egg Spirale, Cooked 4.6 × 1 | 70 | 1.42 |
| Julienne Ham .315 × .315 × 3.78 | 49 | 1.1 |
| Julienne Carrot (2 × .3) – (4.9 × .4) | 91 | 1.19 |
| Surimi (ht.) 1.1 × 2 (dia) | 21.5 | 1.04 |
| Clam (1.2 × .9 × .3) – (2.2 × 1 × .7) | 77 | .97 |
| Shrimp (1.5 × 1.2 × .6) – (3.8 × 1.4 × .8) | 57 | 1.30 |
| Orecchiete Baresi 2¾–3 × 1½ | 70 | 1.42 |
| Pepperoni (2.5–3) (dia.) × (.2–.3) thickness | 50 | 1.08 |
| Black Olives (dia.) 1.7–1.9 | 80 | .40 |

TABLE I-continued

| Ingredient Dimensions<br>Sizes are an approx. range)<br>DENSITY<br>Length × Weight × Thickness (in cms.)<br>gm/cm³ | WATER CONTENT(%) | |
|---|---|---|
| Meatballs (dia.) 1.8–1.9 | 60 | 1.0 |

Figure 2:
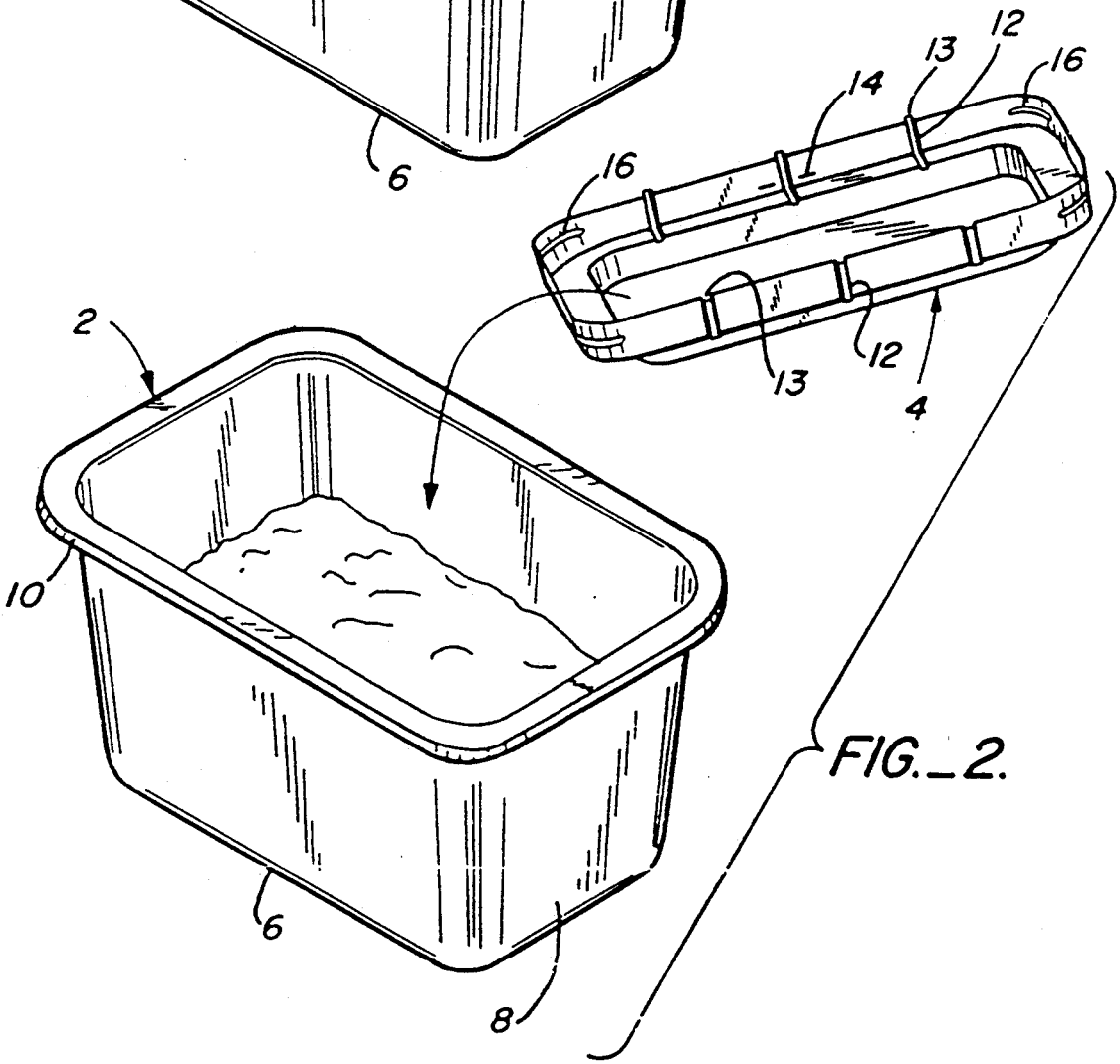
FIG. 2 shows a perspective view similar to that of FIG. 1, except that the closure has been removed and rotated 180°.

Referring to FIG. 1–2 a container 2 and a measuring closure 4 comprise the portable, single serving storage and cooking container used in the invention. The container 2 is preferably cylindrical in form with a preferable depth of about 3½ inches, a width of about 3 inches, and a length of about 5 inches. The volume of the container is about 19 fluid ounces. Naturally, neither the configuration nor the dimensions of the container are critical to the practice of the invention. The container 2 has a bottom panel 6, which may be reinforced, from which a depending skirt 8 extends. An integral bead 10, serves to reinforce the container and to act as a locking mechanism when the container 2 and the closure 4 are combined. The measuring closure 4 has width and height dimensions just slightly greater than those of the container bead 10, so that the closure may tightly engage the container to form a strong seal. However, because of steam and gas build up during the microwave heating process, a plurality of vents 12 are provided in the closure. These vents are channels which are formed during the molding process which lead to orifices 13, which vent off steam. In order to close down the closure 4 onto container 2, the closure is provided with tabs 16, which ride over bead 10 and tightly engage the underside thereof when the closure and container are combined. Also, the closure acts as a measuring cup, and is provided on its interior wall surface with a measuring line 14.

Figure 3:
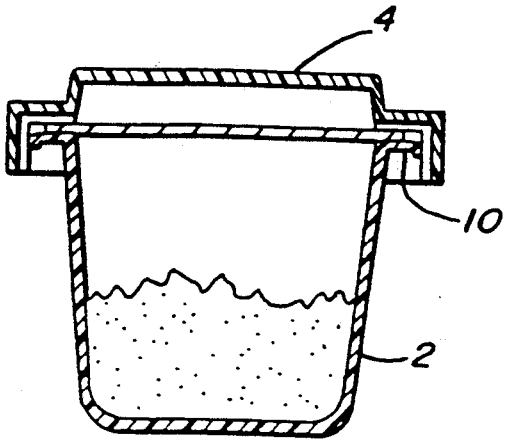
FIG. 3 shows a cross—sectional view of the container with the closure in place.

In storage (FIGS. 2 and 3) the individually quick frozen constituents and the substantially dry sauce concentrate are stored in the container. A removable film over-wrap is generally used to seal the container and is positioned between the closure and the container. Such over-wrap is to prevent moisture exchange from the constituents to the atmosphere and vice versa.

The container and closure 4 may be constructed of any suitable plastic which may be blow-or injection-molded, such as polyethylene, polystyrene, polypropylene, and copolymers of these and other polymers as are known to those skilled in the art. Composite materials may also be used.

Figure 4:
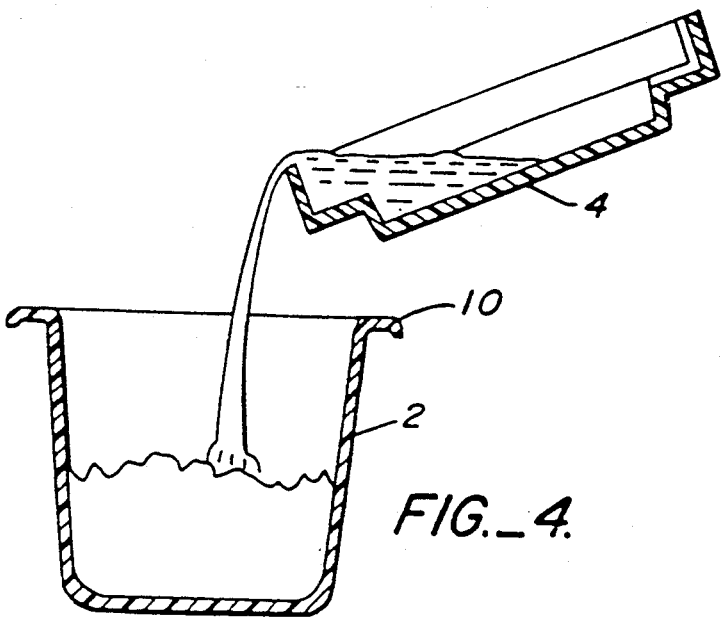
FIG. 4 shows a cross—sectional view of the container being filled with a microwave—power absorbing, comestible liquid medium.
Figure 5:
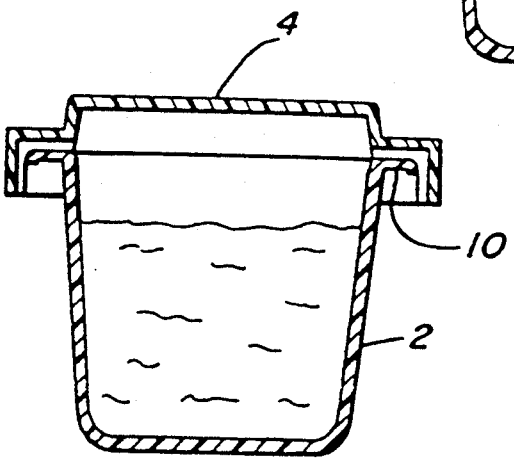
FIG. 5 shows a cross—sectional view of the container during the heating process, with the closure in place.

In operation (FIGS. 3–5), the measuring closure 4 is filled with a microwave-power-absorbing liquid medium which forms part of the edible product. The closure is then snapped onto the container, and placed in a microwave oven, and subjected to microwave radiation. Usually, the liquid is water. Not only does the water act as the heat propagating and conductive medium, but, upon initial application to the frozen comestible, it serves to partially thaw the same, thus further expediting the speed of the heating process. Further, since the water is added as liquid water, it starts to disperse the sauce concentrate. Finally, upon heating, the diluted sauce concentrate begins to bind therein. The water or other liquid medium is typically added a ratio of about 1:10 to 10:1 water to comestible, more preferably about 1:5 to 5:1, and most preferably 1:4 to 4:1. The temperature that the heated product attains is a function of time of heating, and power of the microwave radiation source. However it is preferred that the heated product attain a temperature of at least about 150° F. (65° C.), more preferably at least about 180° F. (82.2° C.).

In the EXPERIMENTAL section below, the products prepared using the inventive method are disclosed.

EXPERIMENTAL

The examples depict, in order, a sauce concentrate (Example 1), the constituents needed to produce a finished product (Example 2), and the method for preparing for immediate consumption (Example 3). Examples 4–11 depict further examples of dry sauce concentrate and the constiuents added thereto to obtain finished products.

| INGREDIENT | GRAM WT. | PERCENT |
|---|---|---|
| DRY INGREDIENTS | | |
| Parmesan Cheese | 200 g | 30.96 |
| Cream Powder (Beatrice Corp.) | 114.65 | 17.74 |
| Non-Fat Dry Milk | 76.50 | 11.84 |
| Clorox Cream Prod. | 64.50 | 10.76 |
| Pure Flo (Mod. Cornstarch, National) | 40.35 | 6.24 |
| Quicksperse (Mod. Cornstarch, National) | 33.25 | 5.14 |
| Salt | 25.50 | 3.94 |
| Instant N-Oil (Mod. Cornstarch, Tapioca, National) | 25.00 | 3.87 |
| Chives | 12.50 | 1.08 |
| Lactic Acid | 7.00 | 1.08 |
| Granulated Onion | 6.50 | 1.01 |
| Granulated Garlic | 6.50 | 1.01 |
| Bacon Flavor HVR Dressing (Clorox Co.) | 5.00 | .78 |
| Mustard Flour | 4.50 | .70 |
| White Pepper | 3.00 | .46 |
| Lecithin 6450 (Central Soya) | 1.50 | .23 |
| Nutmeg | .40 | .06 |
| Romano Cheese | 20.00 | 3.10 |
| | 651.65 | 100.00 |
| WET INGREDIENTS | | |
| Fontina Cheese | 225 g | 42.49 |
| Butter | 120.5 | 23.14 |
| Cream | 120.5 | 23.14 |
| Chicken Base (L.J. Minor's) | 34.5 | 6.51 |
| Gorgonzola | 25.0 | 4.72 |
| | 529.5 | 100.00 |

The dry and wet ingredients are combined in amounts (651.65 grams, 529.5 grams, respectively) to comprise 55.17% and 44.83% of the sauce concentrate, respectively.

EXAMPLE 2

Pasta Alfredo Constituents

To assemble a finished pasta alfredo product, 26.55% of the sauce concentrate of Example 1 is added to the following:

| INGREDIENT | GRAM WT. | PERCENT |
|---|---|---|
| Egg Fettucine | 88.0 | 38.94 |
| Spinach Fettucine | 52.0 | 23.01 |
| Sauce Concentrate (Eg. 1) | 60.0 | 26.55 |
| Ham | 12.0 | 5.31 |
| Carrots | 14.0 | 6.19 |

This provides a 226.0 gram or about 8.00 oz. serving.

EXAMPLE 3

To prepare the finished product of Example 2, about 4 ozs. (113.40 gms) water are added to the product, in a suitably deep microwaveable container with dimensions of about 6 inches in diameter, 3 inches in height, and a volume of about 20 ounces (1¼ pints). The container has a vented cover or closure. The container is placed in a Sharp Carousel II microwave oven, rated at 700 watts, and microwave-heated for two minutes at high power. After heating, the product may, if desired, be stirred once, and reheated to further bind the resulting sauce, but such step is not critical to the invention and is a matter of preference. If the further steps are utilized, however, the stirring step takes about ½ minute (to break up any undispersed sauce concentrate particles) and the reheating step, about 1 minute. Each of the finished products of Examples 5, 7, 9, and 11, below may similarly be subjected to the same heating process.

EXAMPLE 4

Sauce Concentrate for Pasta Primavera*

*Products previously described in Example 1 are not again described in any further examples.

| INGREDIENT | GRAM WT. | PERCENT |
|---|---|---|
| DRY INGREDIENTS | | |
| Parmesan/Romano Cheese Mix | 295.30 | 47.15 |
| Non-Fat Dry Milk | 57.30 | 9.15 |
| Cream Powders | 96.40 | 15.39 |
| Mod. Cornstarches | 83.40 | 13.31 |
| Instant N-Oil | 21.70 | 2.47 |
| Salt, Spices and Seasonings | 69.62 | 11.12 |
| Lecithin | 2.50 | .40 |
| | 626.22 | 100.00 |
| WET INGREDIENTS | | |
| Fresh Onions, Chopped | 239.0 | 43.16 |
| Cream, Heavy | 152.0 | 27.45 |
| Butter | 135.0 | 24.37 |
| Chicken Base | 27.8 | 5.02 |
| | 553.8 | 100.00 |

The wet and dry ingredients are combined in amounts (626.22 grams, 553.8 grams, respectively), to comprise 53.07% and 46.93% of the sauce concentrate, respectively.

EXAMPLE 5

Pasta Primavera Constituents

To assemble a finished pasta primavera product, 26.56% of the sauce concentrate of Example 4 is added to the following:

| INGREDIENT | GRAM WT. | PERCENT |
|---|---|---|
| Ganellini | 98.0 | 43.36 |
| Sauce Concentrate (Eg. 4) | 60.0 | 26.56 |
| Broccoli | 23.0 | 10.18 |
| Carrots | 18.0 | 7.96 |
| Peas | 17.0 | 7.52 |
| Red Bell Peppers | 10.0 | 4.42 |
| | 226.0 | 100.00 |

This provides a 226.0 gram or about 8 oz. serving.

EXAMPLE 6

Sauce Concentrate for Chicken Cacciatore

| INGREDIENT | GRAM WT. | PERCENT |
|---|---|---|
| DRY INGREDIENTS | | |
| Pure-Aid Tomato (Starch/Paste Mix, Pacific Pure-Aid) | 24.30 | 9.32 |

-continued

| INGREDIENT | GRAM WT. | PERCENT |
|---|---|---|
| Tomato Powder | 85.00 | 32.61 |
| Mod. Cornstarches | 74.80 | 28.70 |
| Sugar | 27.70 | 10.63 |
| Salt, Spices and Seasonings | 48.84 | 18.74 |
| | 260.64 | 100.00 |
| WET INGREDIENTS | | |
| Garlic in Oil | 24.0 | 3.41 |
| Onion | 243.0 | 34.57 |
| Olive Oil | 121.0 | 17.21 |
| Carrots | 121.0 | 17.21 |
| Chicken Base | 118.0 | 16.79 |
| Green Bell Peppers | 76.0 | 10.81 |
| | 703.0 | 100.00 |

The wet and dry ingredients are combined in amounts (260.64 grams, 703.0 grams, respectively), to comprise 27.05% and 72.95% of the sauce concentrate, respectively.

EXAMPLE 7

Chicken Cacciatore Constituents

To assemble a finished chicken cacciatore product, 21.02% of the sauce concentrate of Example 6 is added to the following:

| INGREDIENT | GRAM WT. | PERCENT |
|---|---|---|
| Cannestrini | 77.0 | 34.07 |
| Chicken | 30.0 | 13.27 |
| Zucchini | 25.0 | 11.06 |
| Mushrooms | 21.0 | 9.29 |
| Sauce Concentrate (Eg. 6) | 48.0 | 21.24 |
| Tomatoes | 25.0 | 11.06 |
| | 226.0 | 100.00 |

This provides a 226.0 gram or about 8.00 oz. serving.

EXAMPLE 8

Sauce Concentrate for Rigatoni with Meat Sauce

| INGREDIENT | GRAM WT. | PERCENT |
|---|---|---|
| DRY INGREDIENTS | | |
| Tomato PD | 94.4 | 36.92 |
| Mod. Cornstarches | 42.0 | 16.43 |
| Sugar | 18.0 | 7.04 |
| Salt, Spices and Seasonings | 101.28 | 39.61 |
| | 255.68 | 100.00 |
| WET INGREDIENTS | | |
| Vegetable Oil | 140.0 | 21.37 |
| Olive Oil | 20.0 | 3.05 |
| Onion, Fresh | 182.0 | 27.79 |
| Celery, Fresh | 56.0 | 8.55 |
| Ground Mushrooms | 70.0 | 10.69 |
| Carrots, Fresh | 56.0 | 8.55 |
| Ground Ham | 73.0 | 11.15 |
| Beef Base (L.J. Minor) | 58.0 | 8.85 |
| | 635.0 | 100.00 |

The wet and dry ingredients are combined in amounts (235.68 grams, 635.0 grams, respectively), to comprise 28.07% and 71.92% of the sauce concentrate, respectively.

EXAMPLE 9

Rigatoni with Meat Sauce Constituents

To assemble a finished rigatoni with meat sauce product, 20.35% of the sauce concentrate of Example 8 is added to the following:

| INGREDIENT | GRAM WT. | PERCENT |
|---|---|---|
| Pasta Penne Rigate | 122.8 | 54.36 |
| Beef | 22.4 | 9.91 |
| Pork | 14.4 | 6.37 |
| Tomatoes | 20.4 | 9.01 |
| Sauce Concentrate (Eg. 8) | 46.0 | 20.35 |
| | 226.0 | 100.00 |

This provides a 226.0 gram or about 8.00 oz. serving.

EXAMPLE 10

Sauce Concentrate for Seafood Casserole

| INGREDIENT | GRAM WT. | PERCENT |
|---|---|---|
| DRY INGREDIENTS | | |
| Mod. Cornstarches | 124.00 | 48.37 |
| Instant N-Oil | 26.40 | 10.30 |
| Cream Base (Clorox) | 24.00 | 9.36 |
| Salt, Spices and Seasonings | 70.36 | 27.45 |
| Centrolex 6450 (Lecithin, Central Soya) | 8.00 | 3.12 |
| 3H3 (Hydrolyzed Vegetable Protein, Fidco, Nestle) | 3.60 | 1.40 |
| | 256.36 | 100.00 |
| WET INGREDIENTS | | |
| Butter | 340.0 | 27.51 |
| Onion | 600.0 | 48.54 |
| Garlic Oil | 100.0 | 8.09 |
| Clam Base (L.J. Minor's) | 60.0 | 4.86 |
| Lobster Base (L.J. Minor's) | 20.0 | 1.62 |
| Chicken Base | 36.0 | 2.91 |
| Cream | 73.0 | 11.15 |
| | 1,236.0 | 100.00 |

The dry and wet ingredients are combined in amounts (256.36 grams, 1,236.0 grams, respectively), to comprise 17.18% and 82.82% of the sauce concentrate, respectively.

EXAMPLE 11

Seafood Casserole Constituents

To assemble a finished seafood casserole product, 21.68% of the sauce concentrate of Example 10 is added to the following:

| INGREDIENT | GRAM WT. | PERCENT |
|---|---|---|
| Canellini | 104 | 46.02 |
| Sauce Concentrate (Eg. 10) | 49 | 21.68 |
| Surimi | 20 | 8.85 |
| Clams | 25 | 11.06 |
| Broccoli | 18 | 7.97 |
| Shrimp | 10 | 4.42 |
| | 226.0 | 100.00 |

This provides a 226 gram or about 8.00 oz. serving.

| WET INGREDIENTS | | |
|---|---|---|
| Onions, Fresh Chopped | 55.0 | 44.0 |
| Olive Oil | 20.0 | 16.0 |
| Celery, Fresh, Minced | 15.0 | 12.0 |
| Carrots, Fresh, Minced | 15.0 | 12.0 |
| Beef Base | 15.0 | 12.0 |
| Garlic in Oil | 5.0 | 4.0 |
| | 125.0 | 100.00 |

The wet and dry ingredients are combined in amounts (89.95 grams, 125 grams, respectively), to comprise 41.85% and 58.15% of the sauce concentrate, respectively.

EXAMPLE 17

Spaghetti with Meatball Constituents

To assemble a finished spaghetti with meatballs product, 19.91% of the sauce concentrate of Example 16 is added to the following:

| INGREDIENT | GRAM WT. | PERCENT |
|---|---|---|
| Gemellini | 101 | 44.69 |
| Sauce Concentrate (Eg. 16) | 45 | 19.91 |
| Tomatoes, Diced | 35 | 15.49 |
| Mushrooms, Sliced | 15 | 6.64 |
| Meatballs, ½" Dia.,** | 30 | 13.27 |
| | 226.0 | 100.00 |

This provides a 226.0 gram or about 7.06 oz. serving

| **Meatballs | Gram Wt. | Percent |
|---|---|---|
| Ground Pork | 30.00 | 41.32 |
| Ground Beef | 30.00 | 41.32 |
| Salt | 5.20 | 7.16 |
| Granulated Onion | 4.60 | 6.34 |
| Granulated Garlic | 2.30 | 3.17 |
| Black Pepper | .50 | 0.69 |
| | 72.60 | 100.00 |

The foregoing embodiments are not limiting to the invention, and obvious equivalents and the like are within the scope of the invention. The invention is further defined with reference to the claims which are appended hereto.

What is claimed is:

1. A method for preparing a packaged, frozen microwaveable comestible product for consumption wherein the packaged frozen microwaveable comestible product is obtained by combining within a single compartment of a rigid container, predominantly individually quick frozen frozen food constituents having a free water content of from 15–95 wt. % and a substantially dry sauce concentrate having a concentration of 5–50 wt. % based on the total weight of the frozen comestible product and a free water content of less than 70 wt. %; said frozen comestible product comprising said frozen food constituents and said dry sauce concentrate;

wherein said rigid container is capable of both withstanding exposure to microwave power sufficient to heat said frozen comestible product to the temperature for consumption and holding, in addition to said frozen comestible, added water in an amount effective to uniformly heat said frozen food constituents when exposed to microwave power and disperse said dry source concentrate therein; and said method for preparing said packaged, frozen microwaveable comestible product comprising:

(a) adding an amount of water to said frozen comestible comprising said frozen food constituents and said dry sauce concentrate contained within said compartment, wherein the amount of water added is such that the weight ratio of added water to frozen comestible ranges from 1:5 to 5:1 and is added in an amount and manner sufficient to uniformly heat said frozen food constituents when exposed to microwave power, disperses said dry sauce concentrate and form an edible liquid sauce therewith; and (b) heating said frozen comestible and said added water in said compartment with a source a microwave power to a temperature and for a time sufficient to heat the frozen comestible to a temperature for consumption and form said edible liquid sauce.

2. The method of claim 1 wherein the heating step (c) has a duration of no more than 10 minutes at a power of 100 to 2,000 watts.

3. The method of claim 1 further comprising the steps of:

(d) removing said frozen comestible from the source of power and stirring; and (e) reheating said frozen comestible for a short amount of time with a source of microwave power.

4. The method of claim 1 wherein the frozen constituents comprise discretely segregated segments of vegetables, meats, fish, shellfish, pasta and mixtures thereof.

5. The method of claim 1 wherein the sauce concentrate comprises a mixture of dry ingredients and wet ingredients in a ratio of about 1:4 and to about 4:1 wet:dry ingredients.

6. The method of claim 1, wherein heating step (c) is conducted without stirring.

* * * * *